United States Patent [19]

Franklin et al.

[11] 4,056,416

[45] Nov. 1, 1977

[54] RADIATION POLYMERIZED PRIMING COMPOSITIONS

[75] Inventors: Gerald B. Franklin, Philadelphia, Pa.; Clyde F. Parrish, Terre Haute, Ind.

[73] Assignee: The United States of America as represented by the Secretary of the Army, Washington, D.C.

[21] Appl. No.: 636,387

[22] Filed: Dec. 1, 1975

[51] Int. Cl.[2] ..... C06B 45/10

[52] U.S. Cl. ..... 149/19.91; 149/19.92; 149/24

[58] Field of Search ..... 149/19.91, 19.92, 24

[56] References Cited

U.S. PATENT DOCUMENTS

| | | | |
|---|---|---|---|
| 2,111,203 | 3/1938 | Brün | 149/24 |
| 2,157,669 | 5/1939 | Lazier | 149/24 |
| 2,513,391 | 4/1950 | Zenftman | 149/19.91 X |
| 3,055.780 | 9/1962 | Finnegan et al. | 149/24 X |
| 3,423,259 | 1/1969 | Staba | 149/24 |
| 3,441,455 | 4/1969 | Woods et al. | 149/19.92 |
| 3,809,586 | 5/1974 | Waite | 149/19.91 |

OTHER PUBLICATIONS

White, "Compatabilities of Plastics and Energetic Materials in Small Caliber Ammunition, " Dec., 1974, American Defense Preparedness Assn.(Conf.).

Franklin et al., "Radiation Polymerization of Pyrotechnic Compositions, " July, 1974, Proceedings Fourth International Pyrotechnics Seminar, at Denver Research Inst./Univ. of Denver.

*Primary Examiner*—Edward A. Miller

*Attorney, Agent, or Firm*—Nathan Edelberg; Robert P. Gibson; Arthur M. Suga

[57] ABSTRACT

Extrudable priming mixture comprising 32–42% normal lead styphnate, 14–16% antimony sulfide, 30–33% barium nitrate, 3.9–4.1% tetracene, 6–8% aluminum powder, and 4½–8% binder comprising the liquid monomers methyl methacrylate and trimethylolpropanetrimethacrylate, is solidified to a material of admirable percussion sensitivity by radiation polymerization of liquid monomers therein.

10 Claims, No Drawings

RADIATION POLYMERIZED PRIMING COMPOSITIONS

The invention described herein may be manufactured, used and licensed by or for the Government for governmental purposes without the payment to us of any royalty thereon.

This invention relates to priming mixtures for ammunition and more particularly concerns a priming mixture polymerized and hardened by radiation.

There is an increasing requirement in ammunition modernization programs for extrudable priming mixtures for reasons of safety and for ease of adapting these mixtures to automation processes. Most priming mixtures commonly used today are not extrudable, and hence require time consuming hand-rubbing or buttering of the explosive into the primer cup. Those priming mixtures presently used which are extrudable typically contain a high water content necessitating extended drying periods of about 72 hours in their manufacture. An advantage of the present invention is that an extrudable priming mixture has been solidified by radiation to a composition requiring no drying period. The extrudable priming mixture consists of certain explosives and a liquid binder composed of methylmethacrylate (MMA) and trimethylolpropanetrimethacrylate (TMPTMA).

In prior art applications, pyrotechnic substances have been combined with MMA and TMPTMA, the resulting mixture than being polymerized by radiation. However, our priming mixture was formulated by replacing the high explosive pentaerythritoltetranitrate (PETN) of a standard primer mix, with at least an equal amount of binder composed of MMA and TMPTMA, the PETN comprising about 5% by weight of the standard mix. It would have been expected that subsequent to the removal of this high explosive, decreased chamber pressure and decreased projectile velocity would result. Surprisingly, slight increases occurred in both. In addition, unlike typical prior art priming mixes which generally suffer substantial impairment in percussion sensitivity when the binder content therein is increased to about 4½% or more of their total weight, our priming mix showed no such sensitivity impairment under these conditions.

It is a principal object of this invention to provide an extrudable priming mixture.

It is a further object of this invention to provide such an extrudable priming mixture which is electrostatically safe.

Yet another object of the invention is to provide such an electrostatically safe priming mixture which is of admirable percussion sensitivity requiring no drying period.

A still further object is to provide such a priming mixture of admirable percussion sensitivity which has minimal dusting, i.e. shedding of minute particles.

Briefly we have discovered if an extrudable priming mixture comprising by weight about 32–42% normal lead styphnate, about 14–16% antimony sulfide, about 30–33% barium nitrate, about 3.9–4.1% tetracene, about 6–8% aluminum powder, andgabout 4½–8% binder which comprises the liquid monomers MMA and TMPTMA in about 1:1 ratio is irradiated, a hardened mass forms of admirable percussion sensitivity and minimal dusting. The hardening of the mass is caused by polymerization and crosslinking of the liquid monomers therein to form a solid matrix.

In the practice of this invention our priming mixture may be extruded as a dough into a primer cup. Our higher than normal liquid content of the dough in large measure accounts for its good extrudability and reduced susceptibility to electrostatic discharge. Once extruded the dough may be irradiated with 3 to 10 Mrads to insure complete conversion of the liquid "doughy" mass to a solid matrix. A rad may be defined as the quantity of ionizing radiation that results in the absorbtion of 100 ergs of energy per gram of irradiated material, regardless of the source of the radiation. If desired, the irradiation process may be interrupted for periods up to several days and then resumed without detriment. The irradiated mass solidifies requiring no drying period. Preliminary results indicate minimal dusting of the resulting solid, dusting being an occasional cause of explosions in ammunition producing machinery. Additional safety of our irradiated mix resides in the fact that the irradiation step may be conducted at room temperature as opposed to the elevated temperatures required by some prior art applications.

In our priming mixture normal lead styphnate and tetracene serve as primary explosives. Barium nitrate provides the oxidizer while antimony powder and aluminum powder facilitate propellant ignition. Table I below cites effective and preferred percentages by weight of these ingredients in our priming mixture.

Table I

| Ingredient | Composition of Priming Mixtures: Effective Range % | Preferred % |
|---|---|---|
| normal lead styphnate | 32–42 | 37 |
| antimony sulfide | 14–16 | 15 |
| barium nitrate | 30–33 | 32 |
| tetracene | 3.9–4.1 | 4 |
| aluminum powder | 6–8 | 7 |
| binder (MMA/TMPTMA) | 4½–8 | 5 |

Table II below indicates percussion sensitivity of our solidified priming mix for various percentages of our binder, sensitivity being determined by the Bruceton Test. The Bruceton Test measures sensitivity by determining the distance $\bar{H}$ a given weight must fall to detonate a primer 50% of the time, and involves dropping a 4 oz. steel ball at various heights upon a primer. In Table II below, $\sigma$, the standard deviation, provides an indication of the uniformity of manufacture of the tested primers.

Table II

| % Binder (MMA plus TMPTMA)* | Distance to Detonate Primer: H (in.) | $\sigma$ (in.) |
|---|---|---|
| 2 | 10.3 | 1.3 |
| 4 | 8.9 | 1.9 |
| 5 | 5.64 | 1.6 |
| 6 | 11.1 | 2.8 |
| 8 | 10.3 | 1.2 |

*50 rounds per lot

When our binder represents about 5% of the total weight of the priming mix, a preferred priming mixture obtains having optimal sensitivity and extrudability. Suitable results obtain when the binder comprises about 4½–8% by weight of the mix. Above 8% by weight, percussion sensitivity is reduced greatly, and below 4½% extrudability is impaired. The composition of the binder is MMA plus TMPTMA preferably in about a 1:1 ratio by weight.

Our invention may be better understood by reference to the following illustrative example in which our priming composition is prepared.

EXAMPLE I

In a rubber container, 7 g aluminum powder as specified in Military Specification MIL-A-512A, data 22 May 1961, Type III, Grade F, Class 6, 32 g barium nitrate, and 15 g antimony sulfide are dry blended to a uniform mixture. Then 37 g normal lead styphnate and 4 g tetracene are blended together and added to these previously blended substances and mixed. To the aggregate 5 g binder comprising MMA and TMPTMA in 1:1 ratio is introduced and mixed until a "doughy" state obtains.

The resulting doughy composition is then buttered into a primer cup, the anvil next being inserted therein. The assembled primer is then placed in a radiation device consisting of a cobalt 60 gamma source, the total radiation dose to effect conversion of the doughy material to a hard solid matrix being about 5 Mrads.

Using the same procedure of Example I the priming mixtures listed in Table III were also blended and irradiated to form solid priming compositions.

Table III

| Substance | Illustrative Priming Compositions % by Weight | | | |
|---|---|---|---|---|
| normal lead styphnate | 38.2 | 37.4 | 36.6 | 35.8 |
| antimony sulfide | 15.5 | 15.2 | 14.8 | 14.5 |
| barium nitrate | 33.0 | 32.3 | 31.7 | 31.0 |
| tetracene | 4.1 | 4.0 | 4.0 | 3.9 |
| aluminum powder | 7.2 | 7.1 | 6.9 | 6.8 |
| binder (MMA plus TMPTMA) | 2.0 | 4.0 | 6.0 | 8.0 |

The binder disclosed herein may also be advantageously combined with various other explosives such as pentaerythritoltetranitrate, hexanitrostilbene, diazodinitrophenol, trinitrotoluene and the like and irradiated in applications where hazardous pressing or heating of the explosive might otherwise occur such, for example, as pressing of detonator compositions into detonator caps.

It is apparent that we have provided an extrudable priming mixture of good percussion sensitivity, low dusting, which requires no drying period.

We wish it to be understood that we do not desire to be limited to the exact details herein described, for obvious modifications will occur to a person skilled in the art.

We claim:

1. Process for forming a priming composition of admirable percussion sensitivity and low dusting properties comprising irradiating said composition comprising by weight about 32–42% normal lead styphnate, about 14–16% antimony sulfide, about 30–33% barium nitrate, about 3.9–4.1% tetracene, about 6–8% aluminum powder, and about 4½–8% binder comprising methyl methacrylate and trimethylolpropanetrimethacrylate, to form a polymerized, hard, dry solid.

2. Process according to claim 1 wherein said irradiating is achieved using a radiation dose of 3–10 Mrads.

3. Process according to claim 1 wherein said irradiating is conducted at about room temperature.

4. Process according to claim 1 wherein said methyl methacrylate and said trimethylolpropanetrimethacrylate are present in about 1:1 ratio by weight.

5. Process according to claim 1 wherein said normal lead styphnate is present at about 37% by weight, said antimony sulfide is present at about 15% by weight, said barium nitrate is present at about 32% by weight, said tetracene is present at about 4% by weight, said aluminum powder is present at about 7% by weight, and said binder comprising methyl methacrylate and trimethylolpropanetrimethacrylate is present at about 5% by weight.

6. Process according to claim 1 wherein said normal lead styphnate is present at about 36.6% by weight, said antimony sulfide is present at about 14.8% by weight, said barium nitrate is present at about 31.7% by weight, said tetracene is present at about 4.0% by weight, said aluminum powder is present at about 6.9% by weight, and said binder comprising methyl methacrylate and trimethylolpropanetrimethacrylate is present at about 6.0% by weight.

7. Process according to claim 1 wherein said normal lead styphnate is present at about 35.8% by weight, said antimony sulfide is present at about 14.5% by weight, said barium nitrate is present at about 31.0% by weight, said tetracene is present at about 3.9% by weight, said aluminum powder is present in about 6.8% by weight, and said binder comprising methyl methacrylate and trimethylolpropanetrimethacrylate is present at about 8% by weight.

8. An irradiation polymerized priming composition of admirable percussion sensitivity and low dusting properties comprising by weight about 32–42% normal lead styphnate, about 14–16% antimony sulfide, about 30–33% barium nitrate, about 3.9–4.1% tetracene, about 6–8% aluminum powder, and about 4½–8% binder comprising methyl methacrylate and trimethylolpropanetrimethacrylate.

9. Composition according to claim 8, wherein said methyl methacrylate and said trimethylolpropanetrimethacrylate are present in about 1:1 ratio by weight.

10. Composition according to claim 8, wherein said binder comprising said methyl methacrylate and said trimethylolpropanetrimethacrylate is present at about 5% by weight.

* * * * *